United States Patent [19]

Morris

[11] Patent Number: 4,533,005

[45] Date of Patent: Aug. 6, 1985

[54] ADJUSTABLE NOZZLE

[75] Inventor: Wilford V. Morris, Houston, Tex.

[73] Assignee: Strata Bit Corporation, Houston, Tex.

[21] Appl. No.: 553,813

[22] Filed: Nov. 21, 1983

[51] Int. Cl.[3] ..... E21B 10/60; E21B 43/11

[52] U.S. Cl. ..... 175/393; 175/422; 239/600

[58] Field of Search ..... 239/587, 598, 600; 175/339, 343, 422

[56] References Cited

U.S. PATENT DOCUMENTS

| | | | |
|---|---|---|---|
| 1,805,991 | 5/1931 | Metzger | 175/393 X |
| 2,855,182 | 10/1958 | Payne | 255/314 |
| 2,950,090 | 8/1960 | Swart | 255/314 |
| 3,120,284 | 2/1964 | Goodwin | 175/340 |
| 3,447,755 | 12/1966 | Cartwright | 239/600 X |
| 4,360,069 | 11/1982 | Davis | 175/393 |
| 4,381,824 | 5/1983 | Pastusek | 175/229 |
| 4,387,854 | 6/1983 | Dupont | 239/600 X |

FOREIGN PATENT DOCUMENTS

| | | | |
|---|---|---|---|
| 2122670 | 1/1984 | United Kingdom | 175/393 |

*Primary Examiner*—Andres Kashnikow
*Assistant Examiner*—Kevin Patrick Weldon
*Attorney, Agent, or Firm*—Burns, Doane, Swecker & Mathis

[57] ABSTRACT

A nozzle includes a tungsten carbide body and threaded steel sleeve. The nozzle body includes a fluid jet opening arranged to be reoriented in response to rotation of the nozzle body. The nozzle body includes a first set of apertures for receiving a turning tool. The sleeve comprises a split sleeve retained longitudinally upon the nozzle body and is rotatable relative thereto. The sleeve threads are protectively disposed behind a flange of the nozzle body. The sleeve includes a second set of apertures which are alignable with the first set of apertures adjacent an inner end of the latter. The turning tool is engageable with (i) both sets of apertures for rotating the nozzle body and sleeve to install the nozzle, or (ii) with only the first set of apertures to rotate the nozzle body relative to the sleeve against the resistance of an O-ring to reorient the jet opening.

17 Claims, 8 Drawing Figures

Fig. 1
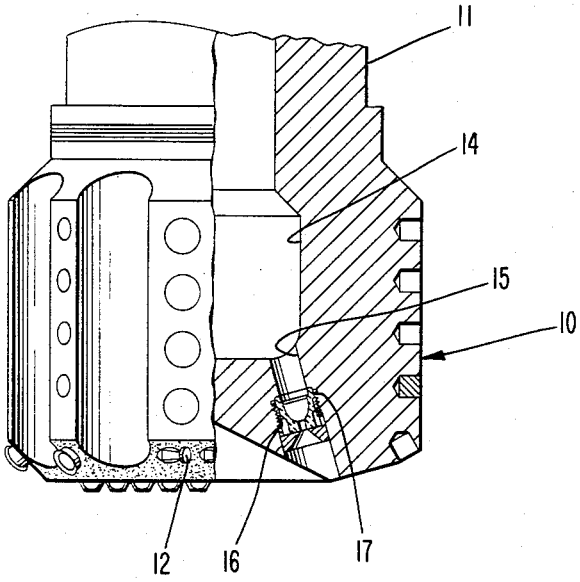
Fig. 2
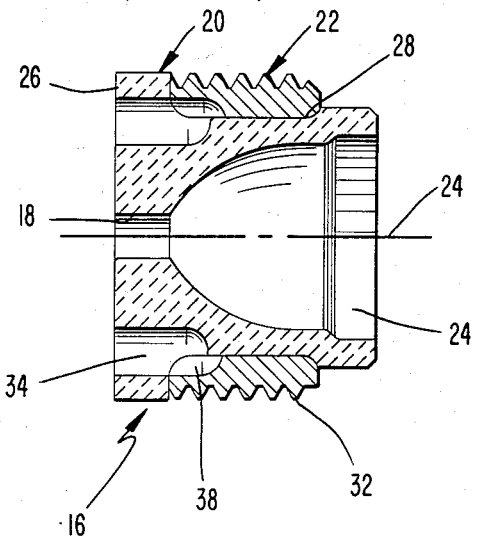
Fig. 3
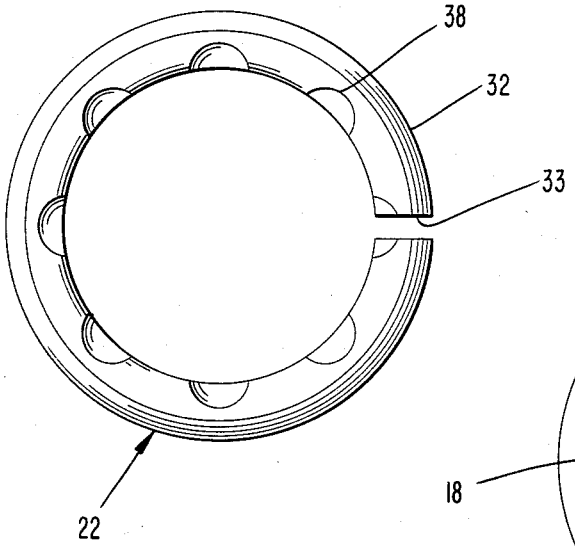
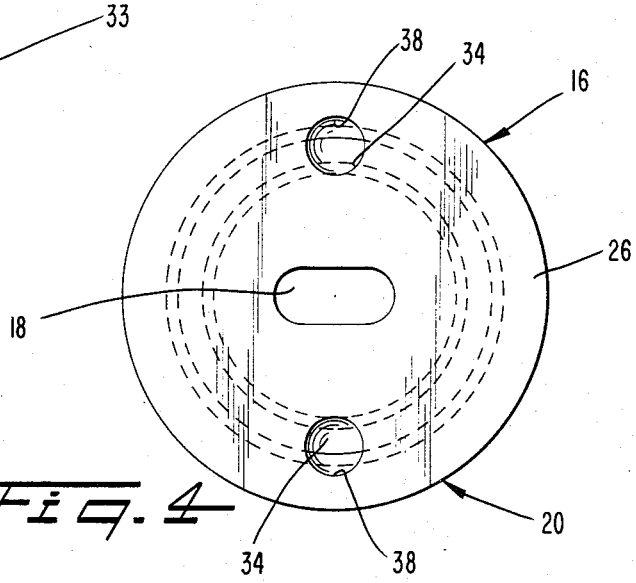
Fig. 4

Fig. 5
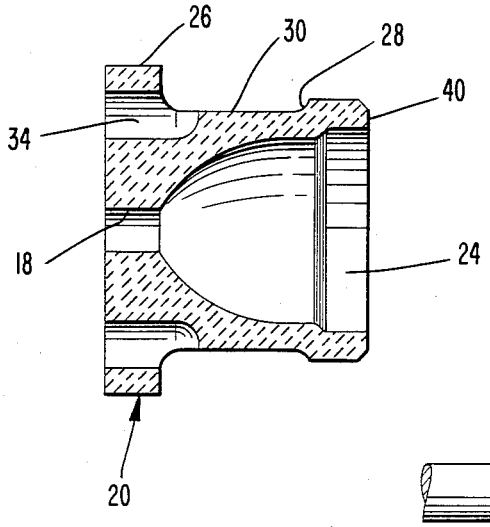
Fig. 6
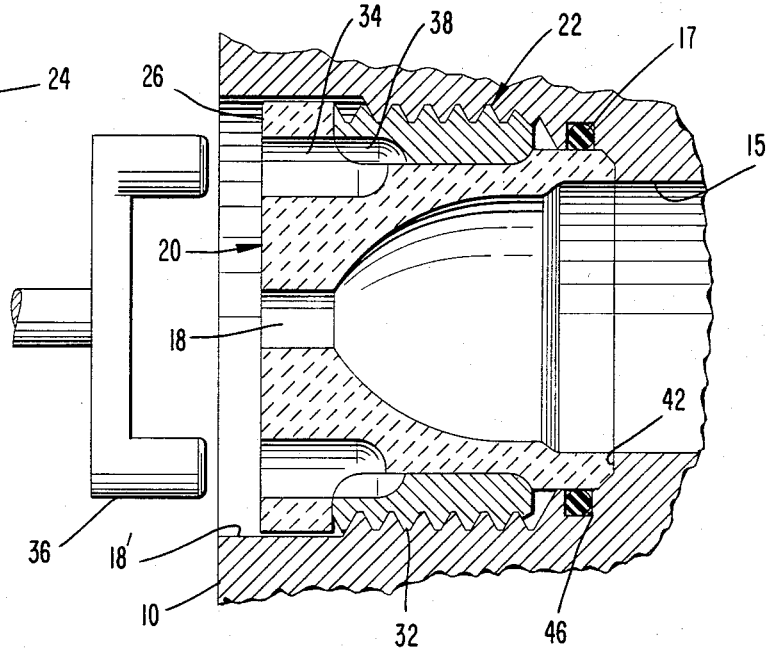
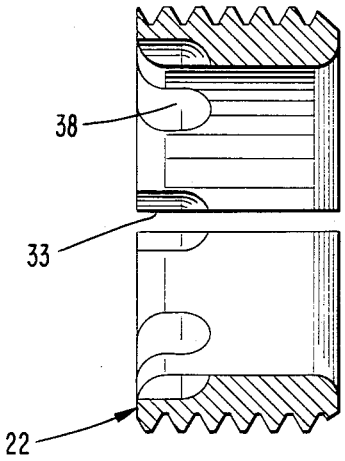
Fig. 7
Fig. 8
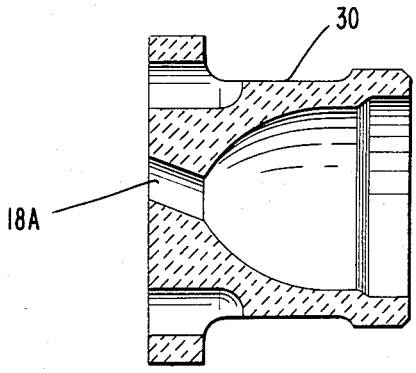

ADJUSTABLE NOZZLE

BACKGROUND AND OBJECTS OF THE INVENTION

The present invention relates to fluid nozzles and, in particular, to hydraulic jet drilling wherein high-speed streams of fluid are emitted from nozzles on the drill bit.

In a typical rotary drilling operation, a rotary drill bit is rotated while being advanced into a soil or rock formation. The soil or rock is cut by cutting elements on the drill bit, and these cuttings are flushed from the borehole by the circulation of drilling fluid toward the top of the hole. The drilling fluid is delivered to the drill bit downwardly through a passage in the drill stem and is ejected outwardly through nozzles disposed in the face of the drill bit face. The ejected drilling fluid is directed outwardly through the nozzles at high speed (e.g., at 100 feet/sec.) to aid in cutting of the rock and cooling of the drill bit.

Conventional nozzles are described in Goodwin U.S. Pat. No. 3,120,284 issued Feb. 4, 1964; Payne U.S. Pat. No. 2,855,182 issued Oct. 7, 1958; Swart U.S. Pat. No. 2,950,090, issued Aug. 23, 1960; and Radtke U.S. Pat. No. 4,381,824, issued May 3, 1983.

In the Radtke patent, a nozzle is removably secured within a bore in the drill bit. The nozzles are proximate to the bottom of the borehole and are subjected to the action of abrasive particles moving at high speeds in that region. Thus, the nozzles are eventually abraded to the point where they fall out or are replaced. Accordingly, the nozzles are attached in a readily replaceable manner, such as by means of a threaded connection between the nozzles and the bores 18 in which they are positioned. A threaded connection is effective in resisting premature dislodgement of the nozzle, aided by the resistance to turning which is imposed by a resilient O-ring seal. An outer flange of the nozzle overlies the threads and protects same since the flange is formed of a hard material such as tungsten carbide, whereas the threads are formed of steel.

The jet openings of the nozzle are typically circular and in alignment with the longitudinal axis of the nozzle. Thus, the orientation of the jet stream is dictated by the orientation of the bores in which the nozzles are mounted and cannot be altered once the nozzles have been installed.

It is an object of the present invention to provide nozzles on a rotary drill bit in which the orientation of the jet can be adjusted after the nozzle has been installed. Laboratory and field testing have indicated improved drilling rates with vortex or elongated nozzles that are oriented properly with polycrystalline diamond bit cutting structures.

Another object is to provide such a nozzle in which the nozzles are threaded, and the threads are shielded against contact by abrasive particles in the borehole.

A further object is to provide such a nozzle in which the nozzles can be securely installed to avoid undue vibration.

SUMMARY OF THE INVENTION

These objects are achieved by the present invention which relates to a nozzle adapted for connection within a cavity of a member to discharge a jet of fluid. The nozzle comprises a nozzle body and a sleeve mounted thereon. The nozzle body is formed of a hard material and includes an outer flange, a jet opening, and a first set of tool-receiving apertures. The jet opening is arranged to discharge fluid and to be reoriented in response to rotation of the nozzle body about a longitudinal axis thereof. The set of tool-receiving apertures is adapted to receive a tool for manually rotating a nozzle body about the axis. The sleeve is retained longitudinally upon the nozzle body and is rotatable relative to the nozzle body. The sleeve includes a coupling structure, such as a helical thread, located inwardly behind the flange for coupling the nozzle to the cavity of the member in response to rotation of the sleeve. The sleeve also includes a second set of tool-receiving apertures which are preferably alignable with the first set of tool-receiving apertures adjacent an inner end of the latter.

The tool is engageable with the second tool-receiving apertures for rotating the sleeve to install the nozzle. The tool is also engageable with only the first set of apertures for rotating the nozzle body relative to the sleeve to reorient the jet opening.

Preferably, the sleeve is in the form of a split member so as to be capable of being snapped onto the nozzle body.

The nozzle is particularly adapted for use within a rotary drill stem for discharging a jet of fluid which aids in the cutting and/or cooling functions. The drill bit is provided with a resilient O-ring which engages the other in order to provide a fluid seal as well as to resist rotation of the nozzle body.

The sleeve is formed of a softer material than the nozzle body to facilitate cutting of threads in the sleeve. The threads are positioned behind the flange of the nozzle body so as to be protected thereby against abrasive particles.

THE DRAWINGS

The objects and advantages of the invention will become apparent from the following detailed description of a preferred embodiment thereof in connection with the accompanying drawings in which like numerals designate like elements, and in which:

FIG. 1 is a side elevational view, partly in longitudinal section of a drill stem in which a nozzle according to the present invention may be mounted;

FIG. 2 is a longitudinal sectional view through a nozzle according to the present invention;

FIG. 3 is a front view of a sleeve portion of the nozzle;

FIG. 4 is a front view of the nozzle with the sleeve mounted on the nozzle body;

FIG. 5 is a longitudinal sectional view taken through the nozzle body of the nozzle;

FIG. 6 is a longitudinal sectional view taken through the nozzle as the latter is secured within the cavity of a member, and also depicting a turning tool in the process of entering the tool-receiving apertures of the nozzle;

FIG. 7 is a longitudinal sectional view taken through the sleeve portion of the nozzle; and FIG. 8 is a longitudinal sectional view taken through the nozzle body of an alternative form of nozzle wherein the jet opening is non-aligned relative to the longitudinal axis of the nozzle body.

DETAILED DESCRIPTION OF A PREFERRED EMBODIMENT OF THE INVENTION

Depicted in FIG. 1 is a rotary drill bit 10 mounted at the end of a drill stem 11. A plurality of cutting elements 12 are fastened in the face of the drill bit for cutting away a rock or earth formation as the drill bit is rotated.

A plurality of nozzles 16 are mounted in the face of the drill bit for discharging high-speed jets of drilling fluid against the bottom of the borehole being cut. The drilling fluid is conducted to the nozzles through a passage 14 in the drill stem which communicates with bore-type cavities 15 in the drill bit. The nozzles 16 are threadedly secured at the outer ends of these bores and include discharge or jet openings 18 through which the drilling fluid is discharged. The jet streams aid in the cutting of the formation, cooling of the drill bit cutters, and carrying of the cuttings to the top of the borehole in the annular space between the drill stem and the borehole wall.

In accordance with the present invention (FIG. 2), at least some of the nozzles 16 comprise a nozzle body 20 and a threaded sleeve 22 coaxially mounted thereon for rotation relative thereto. The nozzle body 20 has a circular cross-section and includes a through-passage 24 which narrows down to one or more of the jet openings 18 at the face of the nozzle body. The jet opening is arranged and configured such that the orientation of the fluid jet emitted therefrom is changed in response to rotation of the nozzle body 20 about its longitudinal axis 24. For example, the jet opening can be of non-circular cross-section (e.g., elongate as depicted in FIG. 4) and aligned with the longitudinal axis 24. Alternatively, the discharge opening 18A (FIG. 8) could be of circular cross-section but non-aligned relative to the axis of rotation; thus, the outlet of the discharge opening is spaced from the axis and is reoriented to a different location as the nozzle body is rotated. Alternatively, the jet opening could be eccentrically disposed relative to the longitudinal axis of the nozzle body and oriented parallel or non-parallel relative to that axis.

The ability to adjust the direction of jet stream flow means that the jet stream flows can be adapted to the particular cutter bit in order to increase cooling efficiency and reduce the localized erosion of the cutters. Tests have indicated, for example, that improved drilling rates can be achieved if elongate jet streams are oriented properly with respect to polycrystalline diamond bit cutting structures.

In each of those cases, the orientation of the jet is changed when the nozzle body is rotated. For example, in the case of the elongate opening 18, a generally horizontally oriented elongate stream can be changed to a generally vertically oriented stream by rotating the nozzle body 90 degrees. In the case of a non-aligned opening 18A (FIG. 8) the directional orientation of the jet is changed upon rotation of the nozzle body.

The nozzle body includes a radial outer flange 26 at its front end and a radial shoulder 28 spaced rearwardly from the flange. The flange and shoulder define an annular groove 30 in which the sleeve 22 is freely rotatably positioned. The sleeve contains external threads 32 and is retained within the groove 30 against longitudinal movement relative thereto by the flange 26 and shoulder 28. The sleeve preferably has a split configuration, i.e., its ends form a gap 33, so that the sleeve can be snapped onto the nozzle body. In this regard, the sleeve is preferably formed of a spring steel in which the threads 32 can be readily formed.

A set of apertures 34 is formed in the nozzle body 20 for the reception of a tool 36 (FIG. 6) for turning the nozzle. The sleeve is provided with a corresponding set of apertures 38 which can be aligned with the apertures 34 in the nozzle body.

The nozzle 16 is installed within the bore 15 of the drill bit 10 by positioning the nozzle within the bore and inserting the turning tool 36 into the apertures 34 of the nozzle body 20 sufficiently far so that the tool also enters the sleeve apertures 38. If necessary, the body 20 and sleeve 22 can first be relatively rotated so as to bring the apertures 34, 38 into mutual alignment. By then rotating the nozzle body and sleeve simultaneously, the sleeve threads 32 become attached to the corresponding threads in the bore 18' to draw the sleeve 22 into the bore. The nozzle body 20 travels along with the sleeve 22 since no relative longitudinal movement can occur therebetween.

Insertion of the nozzle continues in this fashion until an inner end 40 of the nozzle body 20 contacts a stop shoulder 42 of the bore 15. The O-ring seal 17 is disposed within a groove 46 of the bore 15 and is compressed by the nozzle body 20 as the latter passes through the O-ring.

The jet opening 18 of the nozzle body is adjusted to its desired orientation by backing-off the tool 36 slightly so that the tool 36 is no longer disposed within the sleeve apertures 38. Rather, the tool 36 engages only the apertures 34 of the nozzle body 20 so that rotation of the tool produces rotation of the nozzle body 20 relative to the sleeve 22. Thus, the orientation of the opening 18 is varied while the sleeve 22 remains securely attached within the bore 15. The adjustment of the jet orientation can be made for the purpose of changing cutting, cleaning, and/or cooling characteristics thereof, for example.

The thus-adjusted nozzle body 20 remains in its adjusted position by means of frictional contact with the O-ring. That is, during a cutting operation, the pressure of drilling fluid which acts against the upstream side of the O-ring 17 causes the O-ring to be compressed against a side of the groove, i.e., to the left in FIG. 6, whereupon the O-ring bulges radially inwardly into firm frictional contact with the nozzle body 20.

During a cutting operation, the nozzle is secured against vibration since the nozzle body 20 firmly abuts the stop shoulder 42 of the bore 15. Also, the threads 32 of the sleeve 22 are protected against abrasion by means of the overlying flange 26. In this regard, the nozzle body is preferably formed of a hard material such as tungsten carbide.

Since the nozzle body is formed of a hard material it is desirable to form the turning tool 36 of a weaker material which will break prior to the material of the nozzle body if excessive turning force is being applied to the nozzle body. This will avoid breakage of the nozzle body in the event that a resistance to turning is encountered.

In operation, the nozzle 16 is installed by the tool 36 which initially engages both sets of apertures 34, 38 to thread the sleeve 22 into the bore 15. Thereafter, the tool is backed-off to disengage from the apertures 38 of the sleeve 22 so as to rotate only the nozzle body 20 and thereby adjust the orientation of the jet opening 18. In this way, the jet streams are positioned to increase the drilling rate and cooling efficiency, and to reduce the localized erosion of the cutters. The nozzle body is held against rotation by the O-ring 17 during a cutting operation. Vibration of the nozzle is resisted by the engagement of the nozzle body with the stop shoulder 42. Abrasive wear of the threads of the sleeve 22 and bore 15 is minimized due to the protective nature of the overlying flange 26 of the nozzle body.

Although the present invention has been described in connection with a preferred embodiment thereof, it will be appreciated by those skilled in the art that additions, modifications, substitutions, and deletions, not specifically described may be made, without departing from the spirit and scope of the invention as defined in the appended claims.

What is claimed is:

1. A nozzle adapted for connection within a cavity of a member to discharge a jet of fluid, said nozzle comprising:

a nozzle body formed of a hard material and including:

an outer flange, a jet opening arranged to discharge fluid and to be reoriented in response to rotation of said nozzle body about a longitudinal axis thereof, first tool receiving means for receiving a tool to manually rotate said nozzle body about said axis, and a sleeve retained longitudinally upon said nozzle body and being rotatable relative to said nozzle body, said sleeve including:

coupling means located inwardly behind said flange for coupling said nozzle to the cavity of the member in response to rotation of said sleeve, and second tool receiving means, such that the tool is engageable with said second tool receiving means for rotating said sleeve to install said nozzle, and is engageable with said first tool receiving means and disengaged from said second tool receiving means for rotating said nozzle body relative to said sleeve to reorient said jet opening.

2. A nozzle according to claim 1, wherein said first and second tool receiving means each comprise a set of tool-receiving apertures.

3. A nozzle according to claim 1, wherein said nozzle body and sleeve are each rotatable about said longitudinal axis of said nozzle, said nozzle body including longitudinally spaced stops for longitudinally retaining said sleeve.

4. A nozzle according to claim 1, wherein said coupling means comprises a helical thread, said outer flange extending radially outwardly substantially as far as said thread.

5. A nozzle according to claim 1, wherein said jet opening is non-aligned relative to said longitudinal axis.

6. A nozzle according to claim 1, wherein said jet opening is of non-circular cross-section and aligned with said longitudinal axis.

7. A nozzle according to claim 1, wherein said sleeve is of a split construction to be able to be snapped onto said nozzle body.

8. A nozzle according to claim 1, wherein said nozzle body is formed of tungsten carbide and said sleeve is formed of steel.

9. A nozzle according to claim 1, wherein said second tool receiving means is alignable with said first tool receiving means at an inner end of the latter such that the tool engages said first tool receiving means whenever it engages said second tool receiving means, the tool being movable outwardly to become disengaged from said second tool receiving means while maintaining engagement with said first tool receiving means.

10. A nozzle adapted for connection in a bore of a rotary drill bit to discharge a jet of drilling fluid from the drill bit, said nozzle comprising:

a nozzle body formed of tungsten carbide and including:

an outer flange, a jet opening arranged to discharge fluid and to be reoriented in response to rotation of said nozzle body about a longitudinal axis thereof, a first set of tool-receiving apertures for receiving a tool to manually rotate said nozzle body about said axis, longitudinally spaced stop means defining a groove, and a sleeve formed of a softer material than said nozzle body and retained longitudinally in said groove of said nozzle body and rotatable therein relative to said nozzle body about said longitudinal axis, said sleeve including:

threads for threadedly connecting said nozzle to the threaded bore, said threads being located inwardly behind said outer flange so as to be shielded thereby, and a second set of tool-receiving apertures alignable with said first set of tool-receiving apertures at an inner end of the latter, such that the tool is engageable simultaneously with said first and second sets of tool-receiving apertures for rotating both said sleeve and nozzle body to install said nozzle, and is engageable with only said first set of tool-engaging apertures for rotating said nozzle body relative to said sleeve to reorient said jet opening.

11. A nozzle according to claim 10, wherein said jet opening is non-aligned relative to said longitudinal axis.

12. A nozzle according to claim 10, wherein said jet opening is of non-circular cross-section and aligned with said longitudinal axis.

13. A nozzle according to claim 10, wherein said sleeve is of a split construction to be able to be snapped onto said nozzle body.

14. A nozzle according to claim 10, wherein said nozzle body is formed of tungsten carbide and said sleeve is formed of steel.

15. The combination of a rotary drill bit and a nozzle mounted in a cavity thereof for discharging a jet of fluid, said nozzle comprising:

a nozzle body formed of a hard material and including:

an outer flange, a jet opening arranged to discharge fluid and to be reoriented in response to rotation of said nozzle body about a longitudinal axis thereof, and first tool receiving means for receiving a tool to manually rotate said nozzle body about said axis, a sleeve retained longitudinally upon said nozzle body and being rotatable relative to said nozzle body, said sleeve including:

coupling means located inwardly behind said flange for coupling said nozzle to the cavity of the drill stem in response to rotation of said sleeve, and second tool receiving means, such that the tool is engageable with said second tool receiving means for rotating said sleeve to install said nozzle, and is engageable with said first tool receiving means and disengaged from said second tool receiving means for rotating said nozzle body relative to said sleeve to reorient said jet opening, and a resilient element for frictionally resisting rotation of said nozzle body.

16. A nozzle according to claim 15, wherein said second tool receiving means is alignable with said first tool receiving means at an inner end of the latter such that the tool engages said first tool receiving means whenever it engages said second tool receiving means, the tool being movable outwardly to become disengaged from said second tool receiving means while maintaining engagement with said first tool receiving means.

17. The combination of a rotary drill bit and a nozzle mounted in an internally threaded bore in said drill bit, said drill bit having a passage for conducting drilling fluid to said bore, said nozzle comprising:

a nozzle body formed of tungsten carbide and including:

an outer flange, a jet opening communicating with said passage to discharge drilling fluid from said drill bit, said opening being arranged to be reoriented in response to relation of said nozzle body about a longitudinal axis thereof, a first set of apertures for receiving a turning tool for manually turning said nozzle body to reorient said jet opening, and an annular groove located inwardly behind said flange, and an externally threaded, split sleeve formed of steel and threadedly received in said bore, said sleeve being mounted in said groove of said nozzle body for rotation relative to said nozzle body about said longitudinal axis and retained against longitudinal movement relative to said nozzle body within said groove, said sleeve including:

a second set of apertures arranged to be aligned with said first set of apertures adjacent an inner end of the latter, such that the turning tool may be engaged simultaneously with said first and second sets of apertures for rotating said nozzle body and sleeve into said bore wherein said nozzle body abuts a stop of said bore, said tool being engageable with only said first set of apertures for rotating said nozzle body relative to said sleeve to reorient said jet opening, one of said drill bit and said nozzle body carrying a resilient O-ring which bears against the other of said drill bit and nozzle body to resist rotation of said nozzle body.

* * * * *